US005097590A

United States Patent [19]

Tokura

[11] Patent Number: 5,097,590

[45] Date of Patent: Mar. 24, 1992

[54] MANDREL FOR VERTICAL-TYPE PIPE EXPANDING APPARATUS

[75] Inventor: Kenji Tokura, Osaka, Japan

[73] Assignee: Kyoshi Kogyo Kabushiki Kaisha, Osaka, Japan

[21] Appl. No.: 616,856

[22] Filed: Nov. 21, 1990

[51] Int. Cl.[5] ..... B23P 15/26

[52] U.S. Cl. ..... 29/727; 29/890.044; 72/478

[58] Field of Search ..... 29/727, 523, 890.044; 72/478, 482

[56] References Cited

U.S. PATENT DOCUMENTS

| | | | |
|---|---|---|---|
| 4,106,322 | 8/1978 | Moshnin et al. | 72/478 |
| 4,584,765 | 4/1986 | Gray | 29/727 |
| 4,771,536 | 9/1988 | Uanderlaan et al. | 29/727 |
| 4,930,338 | 5/1990 | Tokura | 29/727 |
| 4,980,966 | 1/1991 | Milliman et al. | 29/727 |
| 5,003,691 | 4/1991 | Milliman et al. | 29/727 |

*Primary Examiner*—Irene Cuda
*Attorney, Agent, or Firm*—Koda and Androlia

[57] ABSTRACT

A mandrel for use in a vertical-type pipe expanding apparatus comprising a reciprocating member provided above pipes to be expanded and vertically movable by extending and contracting means; an attachment plate provided adjacent to the underside of the reciprocating member, having a predetermined space gap formed on the upper side, and also having a plurality of penetration holes bores through the attachment plate to hold a plurality of pipe expanding mandrels in such a manner as to prevent the mandrels from slipping off in the direction toward their tip ends, when the mandrels are inserted into the penetration holes to extend vertically downwardly therethrough, the proximal ends of the mandrels being capable of projecting through the reciprocating member from below to above; and a pressing attachment removably installed into the space gap and having pressing surfaces formed to make the proximal ends of the mandrels actuatable in match with positions of the pipes to be expanded. The proximal ends of the mandrels vertically downwardly extending through the respective penetration holes of the attachment plate are provided with engagement steps having the larger diameter than shafts of the mandrels to prevent a drop of the mandrels. The pipes are expanded in any desired array pattern just by replacing the pressing attachment.

5 Claims, 3 Drawing Sheets

MANDREL FOR VERTICAL-TYPE PIPE EXPANDING APPARATUS

FIELD OF THE INVENTION

The present invention relates to a pipe expanding apparatus, and more particularly to a mandrel for a vertical-type pipe expanding apparatus suitable to fixedly connect a number of fins and pipes for use in heat exchangers to each other by inserting mandrels into the pipes under pressure and expanding the pipes.

BACKGROUND OF THE INVENTION

Heretofore, such a mandrel for a vertical-type pipe expanding apparatus is arranged as shown in FIG. 6, for example. A plurality of holes 17 are bored in the lower portion of a reciprocating member 16 of the vertical-type pipe expanding apparatus, and mandrels 18 have their heads 19 fitted into the holes 17. Hard balls 22 or the like being urged by springs 21 are engaged in recessed grooves 20 formed in advance around the heads 19, respectively, whereby the mandrels 18 are locked in place so as to extend vertically downwardly from the reciprocating member.

In such a vertical-type pipe expanding apparatus 23 provided with the mandrels 18 locked to and vertically downwardly extending from the lower portion of the reciprocating member 16, the desired pipe expanding operation is performed as follows. As shown in FIG. 7, when a cylinder 24 mounted at the top of the vertical-type pipe expanding apparatus 23 is extended and contracted, the reciprocating member 16 is forced to move in the vertical direction correspondingly. Upon the downward movement of the reciprocating member 16, tip ends of the mandrels 18 are inserted into pipes 25 to be expanded under pressure, which pipes are previously set below the reciprocating member 16. As a result, the outer diameter of each pipe 25 is increased or expanded so as to fixedly connect the pipes 25 and fins 26, through which the pipes have been previously inserted in place, to each other under pressure.

However, the conventional mandrel for the vertical-type pipe expanding apparatus described above has suffered from the problems as follows.

With the above conventional mandrels, when the number and/or positions of the pipes to be expanded are changed, the number and/or positions of the mandrels attached to the reciprocating member must be modified in accordance with the change intended.

In the prior-art arrangement, therefore, whenever an array pattern of the pipes to be expanded is changed, there occurs the need of removing and attaching a large number of mandrels to rearrange them as required.

In the case of performing such rearranging work of the mandrels, the operation of replacing the mandrels for each row or column is very troublesome and time-consuming, which results in the very poor operability.

Furthermore, although the conventional mandrel utilizes, as locking means, one or more hard balls being urged by the springs for the purpose of facilitating the removing and attaching work of the mandrels, the number of those balls and springs is required to be at least equal to the total number of mandrels attached. This results in the problems of extremely complicating the structure, increasing difficulties in the manufacturing, and raising the production cost.

SUMMARY OF THE INVENTION

It is therefore an object of the present invention to solve all the above-described problems in the prior art, and to provide a mandrel for a vertical-type pipe expanding apparatus which is significantly improved in that the troublesome replacing work of mandrels for each row or column, or removing and attaching work of mandrels, is simplified even when an array pattern of pipes to be expanded is changed; and the high efficient operability and productivity can be achieved, while lowering the cost, through such simplification of both the arrangement and operation.

According to the present invention, the above object is achieved by depressing only those ones of a maximum number of mandrels previously arrayed in pattern which are necessary for the desired pipe expanding operation, rather than removing and attaching the mandrels from and to a reciprocating member individually dependent on a desired array pattern of pipes to be expanded like the prior art.

Specifically, the present invention resides in a mandrel for use in a vertical-type pipe expanding apparatus comprising a reciprocating member provided above pipes to be expanded and vertically movable by extending and contracting means; an attachment plate provided adjacent to the underside of the reciprocating member with a predetermined space gap formed to be left therebetween, and also having a plurality of penetration holes bored through the attachment plate to hold a plurality of pipe expanding mandrels in such a manner as to prevent the mandrels from slipping off in the direction toward their tip ends, when the mandrels are inserted into the penetration holes to extend vertically downwardly therethrough, the proximal ends of the plural mandrels being capable of projecting through the reciprocating member from below to above; and a pressing attachment removably installed into the space gap and having pressing surfaces formed to make the proximal ends of the pipe expanding mandrels, inserted through the respective penetration holes to extend vertically downwardly, actuatable in match with positions of the pipes to be expanded, wherein the proximal ends of the mandrels vertically downwardly extending through the respective penetration holes of the attachment plate are provided with engagement steps having the larger diameter than shafts of the mandrels to prevent a drop of the mandrels.

With the mandrel for the vertical-type pipe expanding apparatus thus arranged, since the mandrels vertically downwardly extending through all the penetration holes previously bored through the attachment plate are provided with the engagement steps at their proximal (upper) ends, the mandrels can be prevented from slipping off in the direction toward their tip ends with the engagement steps latched by complementary steps formed in the penetration holes of the attachment plate.

Also, since the engagement steps are simply latched in the penetration holes of the attachment plate to prevent a slip-off of the mandrels as mentioned above, the mandrels can be attached to the attachment plate just by inserting the mandrels through the respective penetration holes from above the attachment plate.

Accordingly, by installing the pressing attachment, which has the pressing surfaces formed corresponding to positions of those ones of the mandrels that are actually used for the pipe expanding operation, into the space gap between the attachment plate and the reciprocating member, and then operating the reciprocating member to move toward the pipes to be expanded, only those ones of the plural mandrels inserted through the penetration holes of the attachment plate which are necessary for the desired pipe expanding operation, are depressed by the pressing surfaces of the pressing attachment to move ahead together with the reciprocating member for expanding the pipes. The remaining mandrels which are not necessary for the pipe expanding operation are allowed to project or escape upwardly through the reciprocating member without being depressed by the pressing attachment.

DETAILED DESCRIPTION OF EMBODIMENTS

Hereinafter, several embodiments of the present invention will be described with reference to the drawings.

Figure 1:
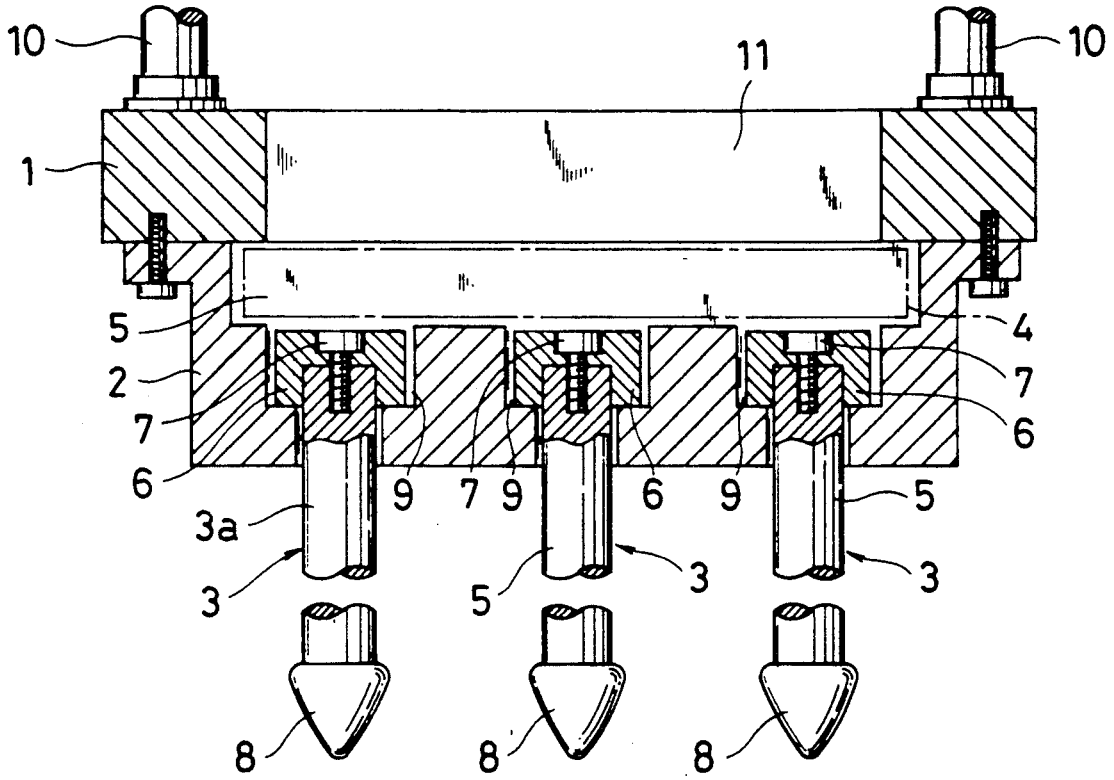
FIG. 1 is a sectional view showing a mandrel for a vertical-type pipe expanding apparatus according to the present invention in an attached state.

In FIG. 1, denoted by reference numeral 1 is a reciprocating member coupled to a pair of extending and contracting rods 10, 10 of respective hydraulic cylinders (not shown) which are mounted on pipe expanding apparatus (not shown). The reciprocating member 1 is movable upwardly and downwardly upon extension and contraction of the rods 10, 10, respectively, and has an opening 11 formed through the center thereof.

Designated by 2 is an attachment plate provided adjacent to the underside of the reciprocating member 1 with a space gap 5 formed to be left therebetween. A pressing attachment 4 provided with pressing surfaces at desired locations corresponding to pipes to be expanded are removably installed in the space gap 5. A plurality of penetration holes 9 each having a step to form a larger diameter portion on the upper side are previously bored through the attachment plate 2 in a desired array pattern matching with a full array pattern of pipes (not shown), to be expanded in the available maximum number.

Designated by 3 is a mandrel inserted slidably in the vertical direction into each of the plural penetration holes 9 bored through the attachment plate 2. To one end of the mandrel 3 opposite to its tip end 8, there is fixed a ring-like head 6 by means of a screw 7, the head 6 being formed to have the larger diameter than a shaft 3*a* of the mandrel. The mandrel 3 latched at its head 6 by the aforesaid step of the penetration hole 9 to be prevented from slipping off downwardly in the direction toward the tip end 8.

Figure 2:
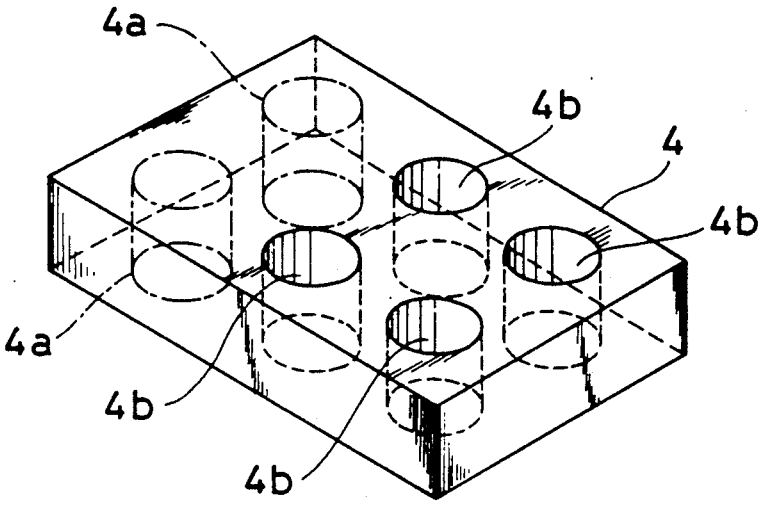
FIG. 2 is a perspective view of a pressing attachment.

By using the thus-arranged mandrel for the vertical-type pipe expanding apparatus according to this embodiment, pipes are expanded in a desired array pattern as follows. For example, in the case the mandrels 3 inserted and latched in the penetration holes 9 of the attachment plate 2 shown in FIG. 1 are arrayed in a pattern of three rows and two columns, i.e., six in the total number, when only two pipes are to be expanded in an array pattern of one row and two columns on the right or left side, the pressing attachment 4 as shown in FIG. 2 is installed into the space gap 5. More specifically, the pressing attachment 4 is provided with pressing surfaces 4*a* brought into abutment against the heads of the mandrels in the same array pattern as that of the pipes to be expanded, whereas penetration guide holes 4*b* are bored through the pressing attachment 4 at locations corresponding to those ones of the mandrels 3 which will not take part in the pipe expanding operation, for allowing the heads of those mandrels to escape upwardly therethrough.

Figure 3:
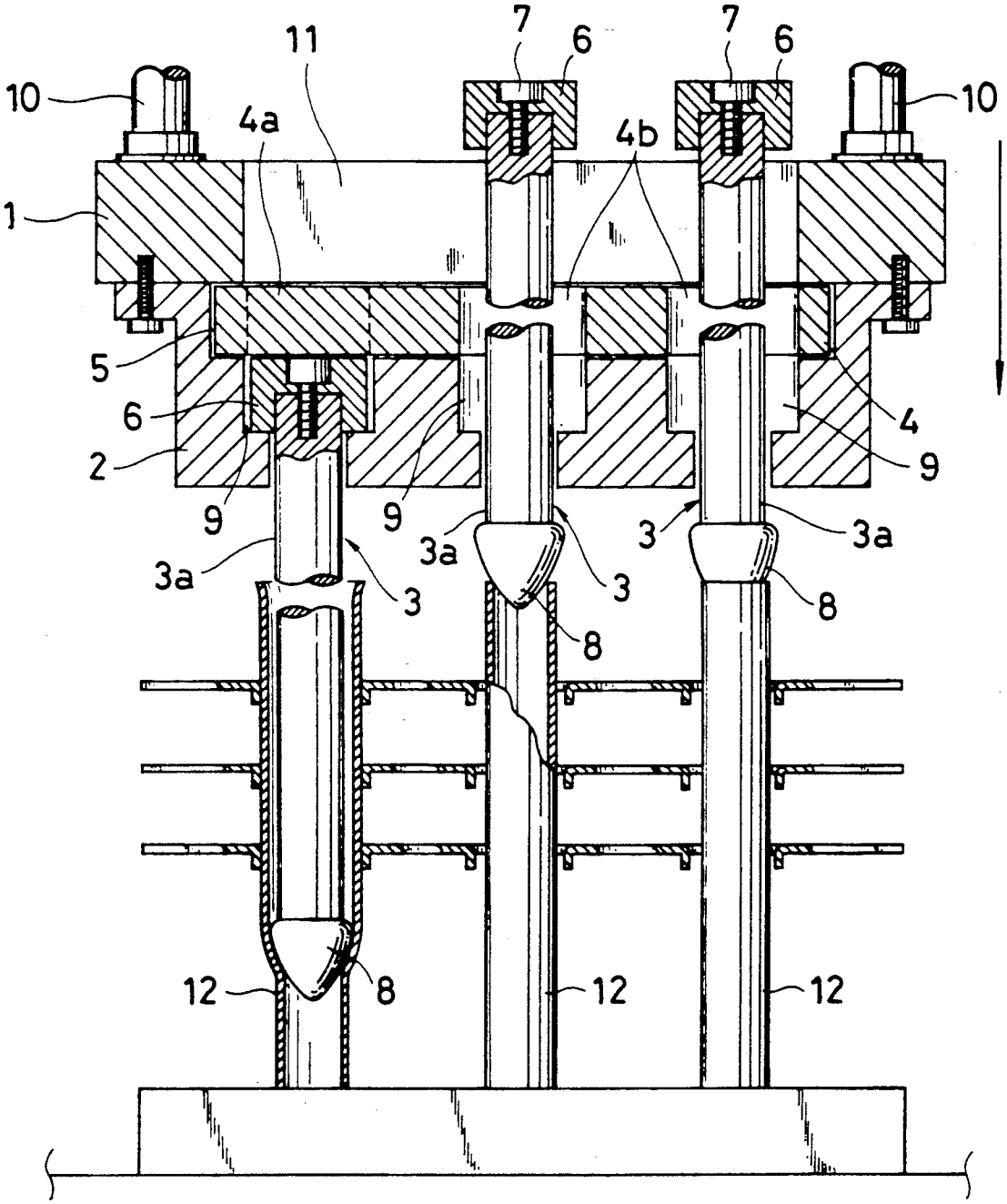
FIG. 3 is reference view showing the mandrel for the vertical-type pipe expanding apparatus according to the present invention in use.
Figure 7:
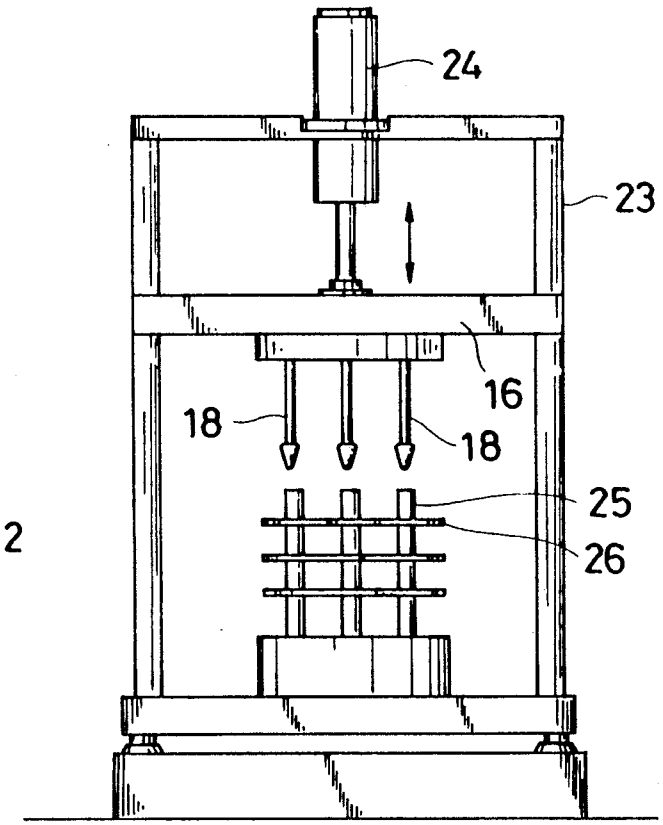
FIG. 7 is a reference view showing the conventional mandrel for the vertical-type pipe expanding apparatus in use.

After installing the pressing attachment 4 in place as mentioned above, when the extending and contracting rods 10, 10 of the hydraulic cylinders (not shown) are operated to descend the reciprocating member 1 as shown in FIG. 3, those ones of the mandrels 3 latched by the attachment plate 2 which locate just below the penetration guide holes 4*b* bored through the pressing attachment 4, are allowed to project or escape upwardly through the corresponding penetration guide holes 4*b* without being depressed by the pressing attachment 4.

Meanwhile, the heads 6 of the remaining mandrels 3 are brought into abutment against the respective pressing surfaces 4*a* of the pressing attachment 4 and are forced to move downwardly upon a descent of the pressing attachment 4. At the same time, the tip ends 8 of those mandrels 3 are inserted under pressure into only those pipes 12 corresponding to the aforesaid array pattern of one row and two columns, for thereby expanding the pipes in a predetermined manner.

In this way, just by replacing the pressing attachment 4 to another one as required which has the pressing surfaces 4*a* at desired locations, it is possible to perform the proper pipe expanding operation in match with any desired array pattern without the need of troublesome work of replacing the mandrels 3 individually, i.e., without touching the mandrels 3 at all.

Figure 4:
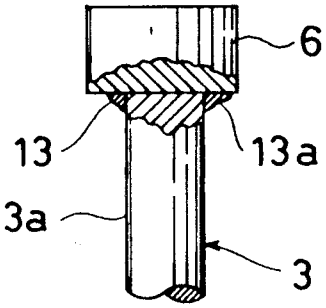
FIGS. 4 and 5 are reference views showing other different embodiments.

In the above embodiment, the ring-like head 6 provided on the mandrel 3 and having the larger diameter than the mandrel shaft 3*a* is joined to the mandrel by means of the screw 7. However, the essence of the present invention resides in an arrangement that the mandrel is formed on its head with such an engagement step as enabling the mandrel to extend vertically downwardly in a removably latched state when it is inserted into the penetration hole 9 bored through the attachment plate 2. In other words, the present invention is not limited to the foregoing embodiment in details of the shape and arrangement. For example, as shown in FIG. 4, the head 6 and the mandrel shaft 3*a* may be permanently joined at 13 to each other by means of a weld 13*a* or the like. As an alternative, the distal end, the shaft and the head of the mandrel may be integrally formed.

Figure 5:
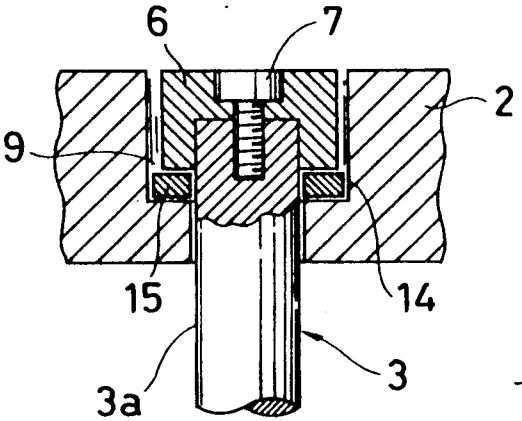
Figure 6:
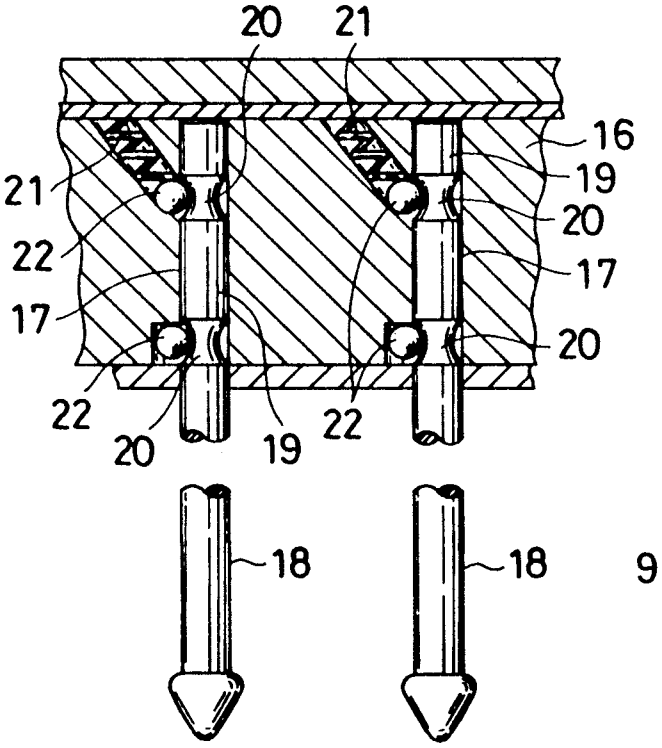
FIG. 6 is a sectional view showing a conventional mandrel for a vertical-type pipe expanding apparatus according in an attached state.

Furthermore, as shown in FIG. 5, a damping member 15 made of rubber or the like may be interposed at an abutment region 14 between the head 6 as the aforesaid engagement step of the mandrel 3 and the attachment plate 2 in the penetration hole 9 bored through the latter. This arrangement is effective in weakening an impact between the head 6 of the mandrel and the attachment plate 2 as produced when the mandrel is relatively descended upon an ascent of the reciprocating member 1, resulting in the increased durability.

Thus, details in arrangement of the pipe expanding apparatus employing the mandrel of the present invention, such as attachment or mounting methods, shapes and forming means for the space gap 5 in which the pressing attachment 4 is to be installed, the attachment plate 2, the reciprocating member 1 and others, can be optionally changed for the designing purpose within a scope of the present invention.

As described above, according to the present invention, there is provided a mandrel for use in a vertical-type pipe expanding apparatus comprising an attachment plate provided adjacent to the underside of a reciprocating member of the vertical-type pipe expanding apparatus with a predetermined space gap formed to be left therebetween, and also having a plurality of penetration holes bored through the attachment plate to hold a plurality of pipe expanding mandrels in such a manner as to prevent the mandrels from slipping off in the direction toward their tip ends, when the mandrels are inserted into the penetration holes to extend vertically downwardly therethrough, the proximal ends of the plural mandrels being capable of projecting through the reciprocating member from below to above; and a pressing attachment removably installed into the space gap and having pressing surfaces formed to make the proximal ends of the pipe expanding mandrels, inserted through the respective penetration holes to extend vertically downwardly, actuatable in match with position of the pipes to be expanded, wherein the proximal ends of the mandrels vertically downwardly extending through the respective penetration holes of the attachment plate are provided with engagement steps having the larger diameter than shafts of the mandrels to prevent a drop of the mandrels. Therefore, even when the array pattern and/or number of pipes to be expanded is changed, the pipe expanding operation can be properly effected just by installing the pressing attachment, which has the pressing surfaces in a desired array pattern, into the space gap while keeping the mandrels latched on the attachment plate, before only required ones of the mandrels corresponding to the pipes to be expanded are depressed under pressure.

Accordingly, unlike the prior art, it is possible to eliminate the troublesome work of removing and attaching a large number of mandrels from and to the reciprocating member individually for each change in the array pattern of the pipes, and to perform the pipe expanding operation with the higher efficiency.

Furthermore, since the mandrel for the vertical-type pipe expanding apparatus according to the present invention is provided with the engagement steps at its proximal (upper) end and is attached simply by inserting the mandrel through the penetration hole of the attachment plate with the engagement step held latched in the penetration hole, the mandrel, the attachment plate and others can be very easily manufactured at the remarkably lowered cost. In addition, the worn mandrel can be readily replaced with a new one by any not-skilled person just by withdrawing it in one direction.

What is claimed is:

1. A mandrel for use in a vertical-type pipe expanding apparatus comprising a reciprocating member provided above pipes to be expanded and vertically movable by extending and contracting means; an attachment plate provided adjacent to the underside of said reciprocating member with a predetermined space gap formed to be left therebetween, and also having a plurality of penetration holes bored through said attachment plate to hold a plurality of pipe expanding mandrels in such a manner as to prevent said mandrels from slipping off in the direction toward their tip ends, when said mandrels are inserted into said penetration holes to extend vertically downwardly therethrough, the proximal ends of said plural mandrels being capable of projecting through said reciprocating member from below to above; and a pressing attachment removably installed into said space gap and having pressing surfaces formed to make the proximal ends of said pipe expanding mandrels, inserted through said respective penetrating holes to extend vertically downwardly, actuatable to match with positions of said pipes to be expanded, wherein the proximal ends of said mandrels vertically downwardly extending through said respective penetration holes of said attachment plate are provided with engagement steps having a larger diameter than shafts of said mandrels to prevent a drop of said mandrels.

2. A mandrel for a vertical-type pipe expanding apparatus according to claim 1, wherein said engagement step is joined to the proximal end of said mandrel by joint means.

3. A mandrel for use in a vertical-type pipe expanding apparatus according to claim 2, wherein said joint means is a screw.

4. A mandrel for use in a vertical-type pipe expanding apparatus according to claim 2, wherein said joint means is a weld.

5. A mandrel for use in a vertical-type pipe expanding apparatus according to any one of claims 1 to 4, wherein a damping member is interposed between said attachment plate formed with said penetration hole bored therethrough and said engagement step of said mandrels vertically downwardly extending through said respective penetration holes of said attachment plate, for thereby preventing direct abutment between said attachment plate and said engagement step.

* * * * *